US007032525B1

(12) United States Patent
Edmondson

(10) Patent No.: US 7,032,525 B1
(45) Date of Patent: Apr. 25, 2006

(54) ENERGY EFFICIENT PYROLYTIC PROCESSING OVEN

(76) Inventor: Jerry M. Edmondson, 2 Escapade Ct., Newport Beach, CA (US) 92663

( * ) Notice: Subject to any disclaimer, the term of this patent is extended or adjusted under 35 U.S.C. 154(b) by 0 days.

(21) Appl. No.: 11/018,205

(22) Filed: Dec. 13, 2004

(51) Int. Cl.
*F23B 7/00* (2006.01)

(52) U.S. Cl. ..... 110/341; 110/229; 110/118

(58) Field of Classification Search ..... 110/230, 110/231, 224, 118, 229, 341, 101 R; 48/77, 48/76

See application file for complete search history.

(56) References Cited

U.S. PATENT DOCUMENTS

| | | | | | |
|---|---|---|---|---|---|
| 4,586,442 | A | * | 5/1986 | Caughey | 48/76 |
| 4,759,300 | A | * | 7/1988 | Hansen et al. | 110/229 |
| 5,279,234 | A | * | 1/1994 | Bender et al. | 110/210 |
| 5,411,714 | A | * | 5/1995 | Wu et al. | 422/232 |
| 5,653,183 | A | * | 8/1997 | Hansen et al. | 110/346 |

* cited by examiner

*Primary Examiner*—Kenneth Rinehart

(57) ABSTRACT

A method and apparatus of converting waste materials into combustible vapor and char utilizing an energy efficient pyrolytic processing oven that eliminates the complex mechanisms usually associated with these systems for heating and transporting the waste material through the oven. The oven of this system has a unique configuration that permits the pyrolized material to free fall through the unit.

5 Claims, 1 Drawing Sheet

ENERGY EFFICIENT PYROLYTIC PROCESSING OVEN

BACKGROUND OF THE INVENTION

1. Field of the Invention

The present invention relates to the treatment of waste and more particularly methods and apparatuses utilizing pyrolysis.

2. Discussion of Prior Art

Walker U.S. Pat. No. 6,619,214 describes a common method and apparatus used in pyrolytic processing of waste. It will be noted that much emphasis is placed on the configuration of the "oven", generally referred to as the "thermal reactor", and the complex mechanisms for conveying the material to be pyrolized through the oven. It has been found that the complexity of the conveying means and the high extent of maintenance and high energy cost, required to keep the mechanisms operable, doom such systems to economic failure.

3. Discussion of the Present Invention

My invention discloses a type of oven that will eliminate the complex conveying mechanisms and high energy and maintenance cost. The oven of my invention is of a unique shape that affords conveyance of the pyrolyzed material through the oven in a "free fall" fashion with the assistance of a high velocity blast of flue gas that fluffs and blows the pyrolized material down an integral chute to the char discharge outlet.

SUMMARY OF THE INVENTION

It is the object of the present invention to provide a pyrolytic means for converting waste matter into valuable commodities, namely combustible vapor and char. The waste matter can include scrap tires, hospital waste and garbage. The combustible vapor can be burned to create heat energy for conversion to electricity and the char can be processed to valuable forms of carbon.

The central component to successful pyrolytic conversion is the oven and all of the ovens preceding the disclosure of my invention have been unreliable and energy inefficient.

My invention through the disclosure of a configuration that eliminates the energy consuming, high maintenance, complex mechanisms normally associated with pyrolysis ovens, makes available an oven that is highly energy efficient, easy to maintain and is safe. The oven disclosed herein will finally make the pyrolysis process a viable means for converting waste materials into valuable commodities, an accomplishment that heretofore has escaped commercial application despite the hundreds of attempts at commercializing the pyrolysis process for waste conversion.

BRIEF DESCRIPTION OF THE DRAWINGS

The drawing illustrates a schematic of the preferred embodiment of the invention. View AA is a side view cutaway showing the external containment vessel with a heating means and with the internal containment vessel configured to provide a chute for conveying the pyrolized material to the char discharge conduit. End View illustrates the preferred cylindrical to obround shape of the containment vessels.

DESCRIPTION OF THE INVENTION

Figure 2:
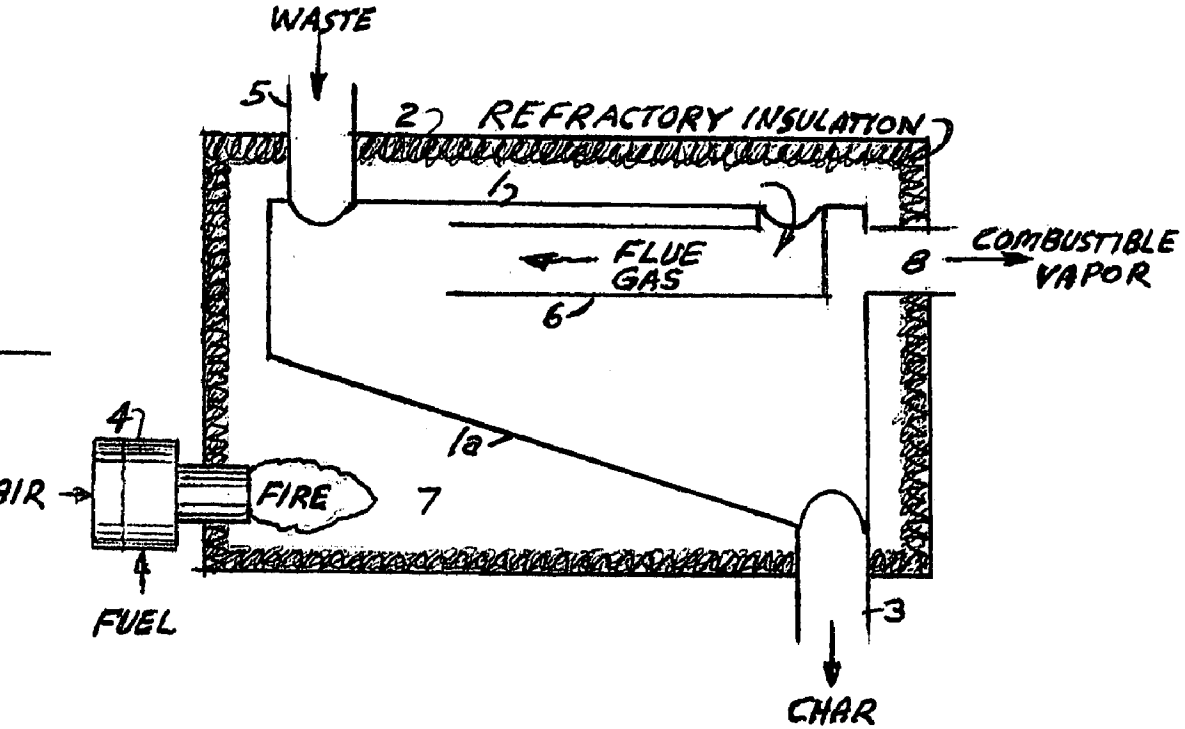
Figure 1:
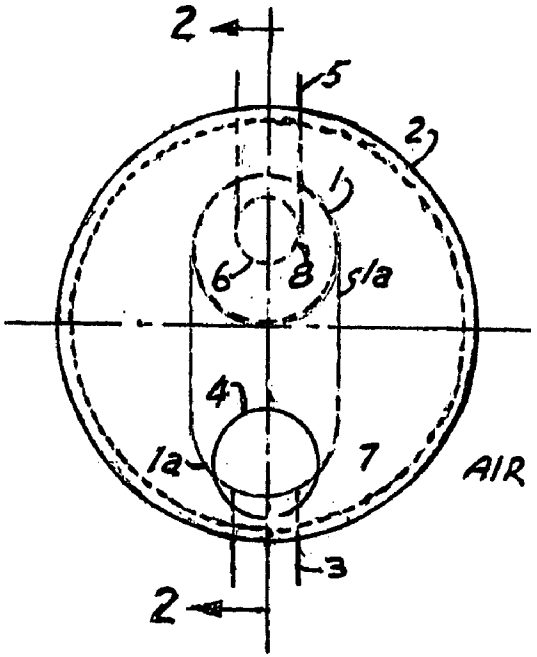

Referring to the drawing, the pyrolytic processing oven consists of a containment vessel 1 suspended inside of a heated refractory insulated vessel 2. The vessel 1 is configured in a unique way so that the bottom 1*a* forms a chute within which pyrolized material can slide to the char outlet 3.

Heat is provided by a fired heating means 4 whereby part of the heat for the pyrolysis process is provided via heat transfer from the flame and the products of combustion (flue gas) through the wall of the containment vessel 1 and part of the heat is provided by direct contact of the waste material entering into the vessel 1 through the inlet conduit 5 by the hot flue gases which are routed through the flue gas conduit 6. The direct contact of the waste material with the hot flue gas improves the heat exchange process and speeds up the pyrolysis of the waste material and facilitates the movement of the char to the char outlet. The unique shape of the vessel 1 with its obround and sloped bottom provides for a space 7 that is a plenum for the flame of the fired heating means whereby the flame doesn't impinge directly upon the wall of the inner vessel 1.

A unique feature of this invention is the introduction of the hot flue gas into the interior of the inside vessel 1 through the conduit 6. Conduit 6 can be constructed of a single tube or a multiplicity of smaller tubes. Using the smaller tubes will increase the heat exchange surface area and increase the flow velocity thereby improving the heat exchange efficiency. The flue gas flowing through the interior of the inside vessel 1 amplifies the conversion of the waste material to vapor and char and motivates the char moving to the char discharge 3.

The combustible vapor exits the inner vessel through conduit 8. Mixing the flue gas with the pyrolized vapor has the benefit of reducing Nox emissions upon the combustion of the combined vapor.

Another unique feature of this invention can include operating the fired heating means 4 with sub-stoichiometric combustion since it is very important for the pyrolysis to take place in the absence of oxygen. The oxygen deficient flue gases resulting from the sub-stoichiometric combustion can be used to purge air from the inner vessel 1 before waste material is introduced into the oven.

Features not shown on the schematic drawing include air "lockout" waste material feed and char discharge systems. A vibrator can be utilized on the char discharge conduit to facilitate the char outflow.

It will be understood that certain features and subcombinations are of utility and may be employed without reference to other features and subcombinations. This is contemplated by and within the scope of the appended claims. It can be readily seen that the objectives and advantages are realized as disclosed by this specification and will be even better understood as described by the appended claims.

What I claim is:

1. A method for converting waste materials to vapor and char utilizing a pyrolytic processing oven comprising:

a) an outer refractory insulated containment vessel employing a fired heating means and suspended within said outer vessel, b) an inner containment vessel constructed of materials conducive of transferring heat said inner vessel configured in a shape whereby the vessel bottom is in the form of an inclined chute with a higher and lower end, c) a waste material inlet conduit that penetrates both the outer and the inner vessels said conduit perpendicular to the upper side wall of both the outer and inner vessels and with the shape of the inner vessel in the form of a circle at the location of the said inlet conduit with the bottom portion of the circle forming the upper end of the bottom chute, d) a char discharge conduit located at the lower end of the said inclined chute formed bottom with said discharge conduit penetrating both the inner and the outer vessels with the shape of the inner vessel at the location of the said discharge conduit being in the form of an obround circle with its minor dimension equal to the diameter of the said circle shape of the vessel at the point where the inlet conduit penetrates the inner vessel, e) and a vapor outlet conduit penetrating both the inner and outer containment vessels located on the obround shaped end of the inner vessel at a location above the char discharge conduit.

2. A method as defined in claim 1 further including a plenum for accommodating the flame of the fired heating means of the outer vessel, said plenum formed in the annular space between the upper end of the said formed bottom chute of the inner vessel and the inside refractory insulated surface of the outer vessel.

3. A method as defined by claim 2 further including a conduit penetrating the top sidewall of the inner containment vessel to transport the products of combustion from the said fired heating means of the outer vessel to the interior of the inner vessel.

4. A method as defined by claim 3 where the said conduit transporting the products of combustion is comprised of a multiplicity of pipes.

5. An apparatus for carrying out the method of claim 4 comprising:

an outer, refractory insulated, containment vessel with fired heating means having suspended inside, an inner vessel constructed of materials conducive of heat transfer formed to where its bottom side wall is shaped as a chute with upper and lower ends, the inner vessel is circular at the upper end and obround at the lower end, there is an inlet conduit penetrating both the outer and inner containment vessels near the upper end of the inner vessel, a char discharge conduit near the lower end that penetrates both containment vessels and a vapor outlet conduit penetrating both vessels located above the char discharge conduit, the fired heating means is positioned so that its flame is contained in the annular space between the inside refractory insulated surface of the outer vessel and the upper end of the chute formed bottom of the inner vessel and there is a multi tube conduit penetrating the upper side wall of the inner vessel into the interior of the inner vessel for transporting the products of combustion from said fired heating means into intimate contact with the waste material entering the inner vessel.

* * * * *